US005265397A

United States Patent [19]

DePoint et al.

[11] Patent Number: 5,265,397

[45] Date of Patent: Nov. 30, 1993

[54] FLEXIBLE APPARATUS AND PROCESS FOR LOADING AND SEALING POUCHES

[75] Inventors: John DePoint, Palmyra; Michael L. Koelsch, Rochester, both of N.Y.; Vincent J. Panzarella, Greenfield; David R. Voves, Mukwonago, both of Wis.

[73] Assignee: Eastman Kodak Company, Rochester, N.Y.

[21] Appl. No.: 810,982

[22] Filed: Dec. 20, 1991

[51] Int. Cl.[5] ..... B65B 5/06; B65B 31/04; B65B 43/26

[52] U.S. Cl. ..... 53/434; 53/284.7; 53/459; 53/469; 53/512; 53/571

[58] Field of Search ..... 53/255, 284.7, 374.8, 53/386.1, 434, 459, 469, 512, 526, 571, 436, 572, 573, 570, 228, 234

[56] References Cited

U.S. PATENT DOCUMENTS

| | | | |
|---|---|---|---|
| 2,400,682 | 5/1946 | Bronander | 53/234 X |
| 2,443,952 | 6/1948 | Gilbert | 42/234 X |
| 2,888,792 | 6/1959 | James . | |
| 2,952,954 | 9/1960 | Perrin | 53/571 X |
| 3,097,463 | 7/1963 | Neal et al. . | |
| 3,107,793 | 10/1963 | Frank . | |
| 3,269,091 | 8/1966 | Martin . | |
| 3,307,326 | 3/1967 | Krebs | 53/228 X |
| 3,511,014 | 5/1970 | Kochalski | 53/526 X |
| 3,589,411 | 6/1971 | Vogt | 53/571 X |
| 3,676,977 | 7/1972 | Rothmann | 53/459 X |
| 3,914,921 | 10/1975 | Doran . | |
| 3,939,624 | 2/1976 | Gidewall . | |
| 4,205,501 | 6/1980 | Michels | 53/228 |
| 4,221,101 | 9/1980 | Woods . | |
| 4,369,611 | 1/1983 | Canfield . | |
| 4,377,061 | 3/1983 | Olson et al. | 53/526 X |
| 4,457,124 | 7/1984 | Hartmann | 53/512 |
| 4,664,161 | 5/1987 | Sawa . | |
| 4,726,170 | 2/1988 | Sawa . | |
| 5,024,042 | 6/1991 | Meyer | 53/571 X |

FOREIGN PATENT DOCUMENTS 2074972A 11/1981 United Kingdom .

*Primary Examiner*—John Sipos
*Assistant Examiner*—Linda Johnson
*Attorney, Agent, or Firm*—Charles E. Snee, III

[57] ABSTRACT

A flexible apparatus and process are disclosed for loading objects into pouches and then sealing the pouches, in which a pouch (10) having side walls (12,14) and an open mouth (18) is moved from a source (34) to a pouch opening apparatus (72) where the mouth is opened to pass an object such as a stack (20) of slippery sheets which is pushed through the mouth into the pouch while the object is resiliently engaged through the walls of the pouch by a mechanism (70, 82–110) to prevent the object from shifting during movement into or with the pouch, after which the pouch and object are moved, while still resiliently engaged, to a station (74) at which the pouch is evacuated and sealed. Changes are readily accomodated in object size, pouch size or format, or all of these.

16 Claims, 8 Drawing Sheets

FLEXIBLE APPARATUS AND PROCESS FOR LOADING AND SEALING POUCHES

DESCRIPTION

1. Technical Field

This invention concerns apparatus and processes for loading and closing containers. More particularly, the invention concerns flexible apparatus and processes for inserting frequently changing types of objects, such as different sized stacks of sheet materials like slippery X-ray film sheets, into correspondingly different sized or formatted pouches with open mouths; then evacuating the interior of the pouches to conform the walls to the shape of the objects; and finally sealing the pouches.

2. Background Art

A great variety of apparatus and processes is known for wrapping or pouching many types of objects in containers made from flexible materials. Such known apparatus and processes are limited in their abilities to adjust readily for changes in the size of the objects, the size or format of the container or both. Many such known apparatus and processes are also limited in their abilities to wrap or pouch objects which require more gentle handling due to their ease of damage or their unstable structure, for example. In the latter category may be included stacks of sheet materials such as slippery sheets of X-ray film, which must be handled carefully due to sensitivity of the film to scratches, pressure marks and the like. In addition, stacks of sheets of X-ray film and other materials having slippery surface properties are easily shifted out of their desired right-rectangular stack configuration. This is because, in response to a relatively slight nudge or the force of rather modest acceleration or deceleration, such slippery sheets will readily slide along one another to produce an irregularly shaped, skewed stack which is difficult to handle and package. A need has existed for improved apparatus and processes which are flexible enough to handle changes in object size, the size or format of the container or both; and to handle difficult products such a slippery film sheets.

SUMMARY OF THE INVENTION

The apparatus of the invention comprises a hopper or other source of pouches for the objects to be packaged, each pouch having side walls and an open mouth, and a support surface convenient to the hopper. Means such as a general purpose programmable robot may be provided for removing a pouch from the source and placing the pouch on the support surface, or the removal may be done manually or in any suitable manner. A reference point or feature on each pouch, such as a corner near its open mouth, preferably is positioned at a fixed reference point on the support surface, without regard to the size of the pouch. Means are provided for opening the mouth of the pouch and holding the mouth open while the pouch is filled. The object to be packaged is received at a position opposite the mouth, by manual placement or by means of a such as a general purpose programmable robot. Means are provided for pushing the object through the mouth into the pouch. Preferably, a reference point or feature on each object, such as a corner on a stack of sheets, is positioned at a fixed reference point opposite the mouth of the pouch, without regard to the size of the object; so that, each size of object is properly positioned for its respective size of pouch. To prevent the object from shifting its configuration or position as it is pushed into or as it moves with the pouch, means are provided for resiliently engaging the object through the side walls of the pouch as the object is pushed into the pouch and as the object subsequently moves with the pouch. The pouch and object preferably are resiliently engaged in this fashion while they are moved to a station at which the interior of the pouch is evacuated and the pouch is sealed.

The support surface may comprise a plurality of rails separated by longitudinally extending slots. In this embodiment, the means for resiliently engaging comprises a frame having a first element extending above the support surface and a second element extending beneath the support surface. A resilient pad is mounted on the first element facing the support surface and means are included for moving the resilient pad toward and away from the support surface. A plurality of elongated members are positioned opposite respective ones of the longitudinally extending slots; and means are mounted on the second element for supporting the elongated members and for moving the elongated members through and withdrawing them from the longitudinally extending slots to engage and release the pouch and the enclosed object. The means for resiliently engaging preferably is comprised in a shuttle means for moving the pouch and the object along the support surface after insertion of the object into the pouch, while still resiliently engaging the object within the pouch, to a further means for evacuating the interior of the pouch and sealing the pouch at its mouth. Preferably, the pouch and object are moved a fixed distance from the position at which the object is inserted to the position at which the pouch is evacuated and sealed, without regard to the size of said pouch or said object. Means for removing a pouch from its hopper may be mounted on the shuttle means; so that, a new pouch is positioned for filling as the previously filled pouch is moved for evacuating and sealing. Means for removing an evacuated and sealed pouch from the support surface also may be mounted on the shuttle means; so that, a completed package is removed as a new one is moved into position for evacuating and sealing.

The process of the invention comprises the steps of providing a source of pouches for the objects to be packaged, each pouch having side walls and an open mouth; providing a support surface; removing a pouch from the source and placing the pouch on the support surface; opening the mouth of the pouch; placing an object at a position opposite the open mouth; pushing the object through the open mouth into the pouch; and during the pushing step, resiliently engaging the object through the side walls of the pouch to prevent the object from shifting during movement into or with the pouch. After the object has been pushed into the pouch, the process comprises the further steps of moving the pouch and the object along the support surface while continuing to resiliently engage the object through the side walls of the pouch to prevent shifting during movement; evacuating the interior of the pouch; sealing the pouch at the mouth; and releasing the completed package. Preferably, the pouch and the object are moved a fixed distance along the support surface after the pushing step and before the evacuating and sealing steps, without regard to the size of the pouch or the object. Since the process of the invention uses premade pouches open only along one side, the other sides of the pouch can be provided with various other features required for a particular pouch format, yet such alternate formats can still be handled in accordance with the process of the invention.

DESCRIPTION OF THE PREFERRED EMBODIMENTS

Figure 1:
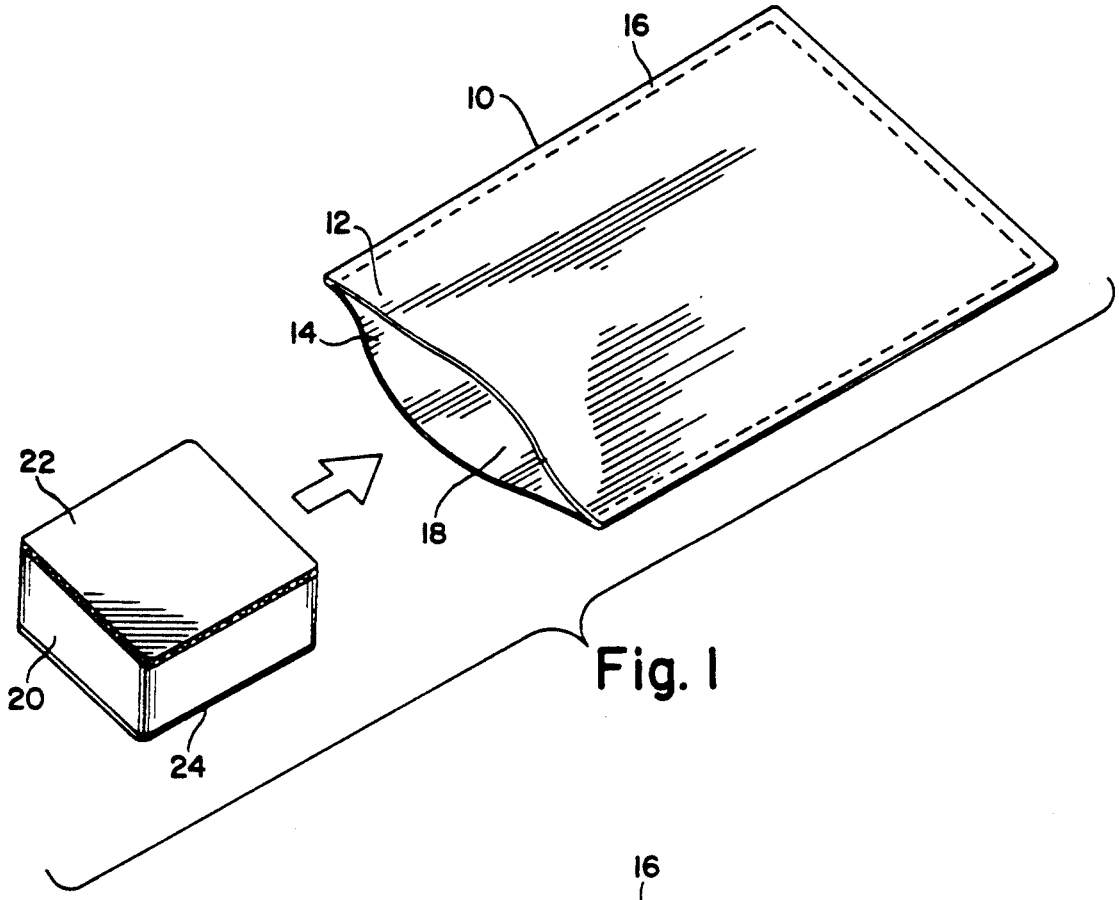
FIG. 1 shows a perspective view of an object and pouch of a type useful in the apparatus and process of the invention.

The following is a detailed description of the preferred embodiments of the invention, reference being made to the drawings in which the same reference numerals identify the same elements of structure in each of the several Figures.

OVERALL PROCESS

Figure 2:
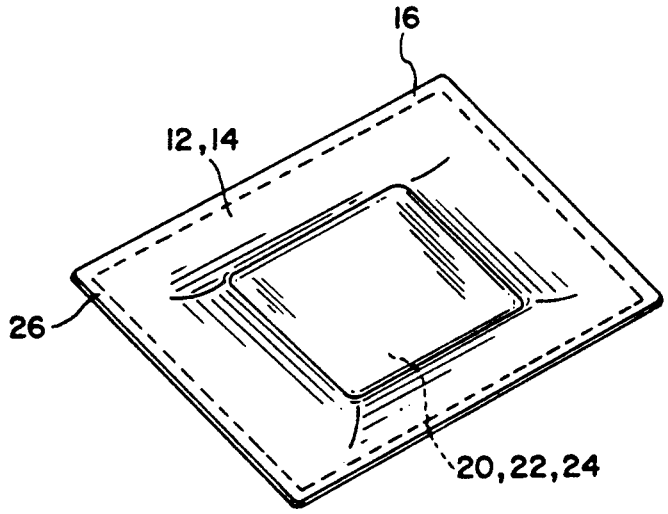
FIG. 2 shows a perspective view of a completed package of a type produced by the apparatus and process of the invention.

FIG. 1 shows a pouch and an object of some typical types suited for use in the present invention. The pouch 10 may be made from any suitable material but preferably the material is gas impervious and can be heat sealed. Pouch 10 may be formed from a pair 12,14 of generally congruent side walls joined on three sides by a peripheral seal 16, such as a continuous heat seal. These three sides may be provided with flaps, rip strips or other features desired for a particular application. The remaining side or portion of the periphery of pouch 10 remains open to define a mouth 18. Such pouches can be stacked flat and are readily picked up and moved by conventional means such as suction cup arrays. A typical object to be packaged would be an essentially right rectangular stack 20 of sheet material, such as slippery X-ray film sheets, covered top and bottom by dunnage cards 22,24 to protect the object during handling. With mouth 18 held open by conventional means such as a suction cup array, the object can be pushed into pouch 10. When the object is a stack of slippery sheets, acceleration of the stack toward pouch 10 and contact of the stack with pouch 10 can cause the stack to shift or skew from its preferred right rectangular configuration. Other objects can reorient or even fall over during this same process. Thus, in accordance with the invention as will be discussed with regard to FIGS. 3 to 9, the object preferably is resiliently engaged through side walls 12, 14 as it moves into the pouch and as the pouch is moved away after filling. Once the object has been positioned within pouch 10, the interior of pouch 10 is evacuated to cause the side walls 12, 14 to conform generally to the shape of the object; and mouth 18 is closed by a seal 26, to produce a packaged object of the general configuration shown in FIG. 2.

OVERALL ARRANGEMENT AND OPERATION OF APPARATUS

As shown in FIGS. 3 to 7, the apparatus of the invention comprises a rugged L-shaped frame 28 having a plurality of legs 30 which support horizontal mounting plates 32 for the various parts of the apparatus. A source or hopper 34 for a supply of pouches 10 is mounted to or adjacent to frame 28. Hopper 34 comprises a fixed forward wall 36 against which the edges of mouth 18 are placed, the left most edge of wall 36 as viewed in FIG. 3 forming a fixed reference corner 38 for hopper 34 against which are positioned the upper left corners of all sizes of pouch 10. Hopper 34 also comprises, in the conventional manner, a movable wall 40 and a movable wall 42 whose positions may be adjusted by suitable means, not illustrated, to configure the hopper for pouches of various sizes; however, in each instance the upper left corner of the pouch will be positioned against reference corner 38. Hopper 34 also may comprise in the conventional manner a movable bottom wall, not illustrated, for maintaining the uppermost pouch at a fairly constant height relative to frame 28.

Near hopper 34 on mounting plate 32 of frame 28 is provided a means or nest 44 for receiving objects to be packaged, which comprises a fixed side wall 46 whose outfeed edge forms a fixed reference corner 48 for nest 44 at which all sizes of object are positioned before movement into a pouch 10. A movable side wall 50 is provided opposite fixed side wall 46 and may be moved toward side wall 46 by any suitable means such as a pneumatic actuator 52 attached to mounting plate 32. At the outfeed ends of side walls 46,50 are mounted pivotable guide plates 54,56 which are rotatable about vertical axes by conventional means to the illustrated phantom positions in which they serve to guide objects from nest 44 toward an open pouch, in a manner to be discussed. At the outfeed edge of the floor of nest 44 are mounted stop plates 58 which are pivotable about horizontal axes by conventional means to the illustrated phantom positions in which they allow the objects to pass from the nest.

Behind nest 44 on mounting plate 32 is provided a conventional means 60 for pushing objects from between side walls 46,50 once guide plates 54,56 and stops 58 have been moved to their phantom positions. Means 60 may comprise a simple pusher plate for stacks of sheet materials or an open ended frame for arrays of objects, not illustrated. A conventional long-stroke actuator 62 is provided for moving means 60 between side walls 46,50. Means 60 and actuator 62 may be mounted on a carriage 64 for movement transverse to the direction of movement of means 60, to permit the position of means 60 to be adjusted for objects of different widths. A conventional long stroke actuator 66 may be attached to mounting plate 32 for positioning carriage 64.

Figure 3:
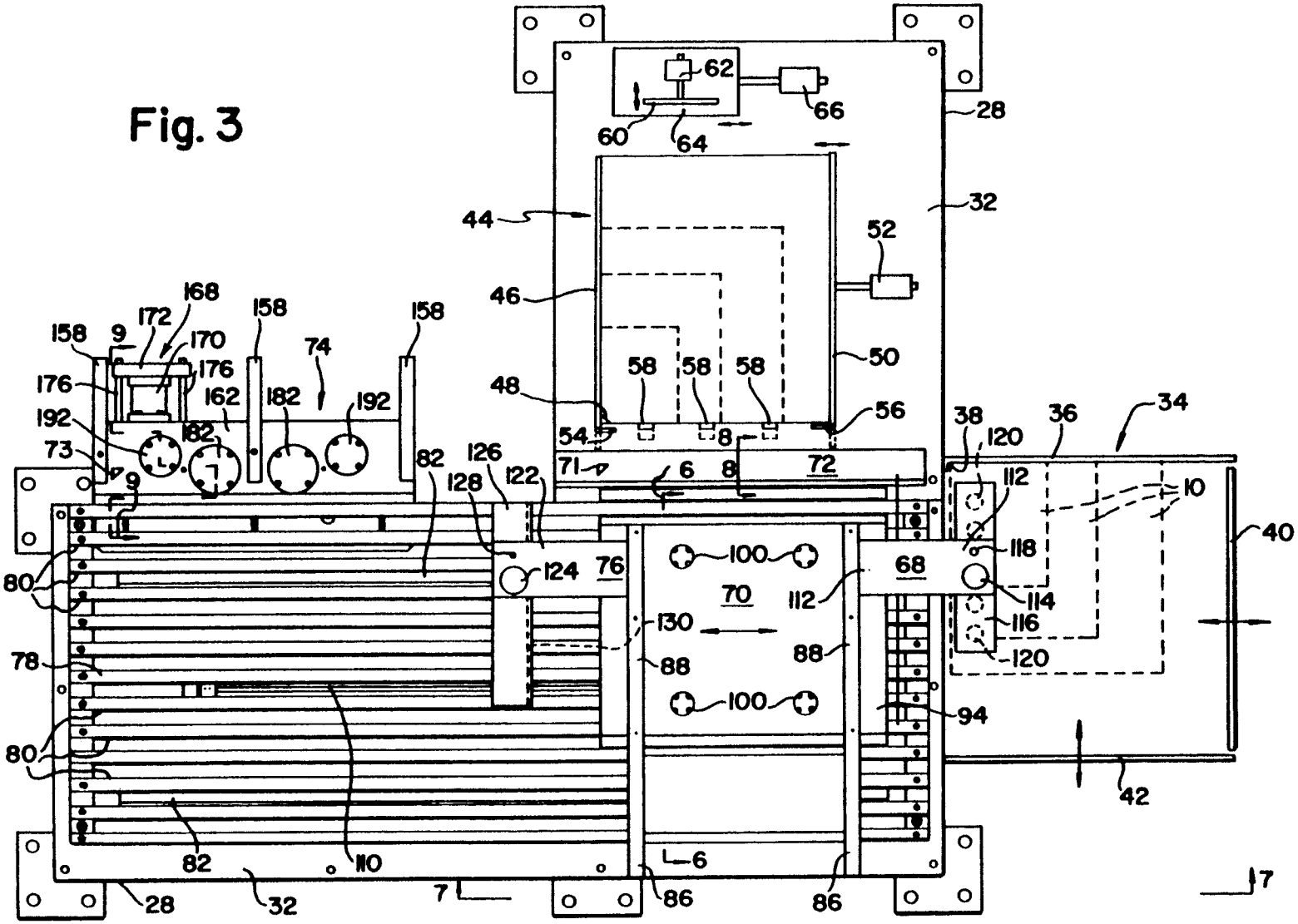
FIG. 3 shows a plan view of the apparatus of the invention.

Pouches 10 may be removed from hopper 34 by any suitable means, such as manually or with a programmable robot; but in the illustrated embodiment, a means 68 for removing pouches 10 is mounted for movement with a means or shuttle 70 which comprises means for resiliently engaging each object through the walls of its pouch. As shuttle 70 moves to the left as seen in FIG. 3, means 68 removes a pouch from hopper 34 and positions the pouch with its upper left corner at a fixed reference point 71 within a means 72 for opening the mouth of the pouch. Simultaneously with pickup and movement of an empty pouch from hopper 34, shuttle 70 resiliently engages and moves the previously filled pouch to the left and positions the filled pouch with its upper left corner at a fixed reference point 73 within a means 74 for evacuating and sealing the pouch. The distance from reference point 38 to reference point 71 preferably is equal to the distance from reference point 71 to reference point 73. A means 76 for removing filled, evacuated and sealed packages also is mounted for movement with shuttle 70. Thus, in one leftward movement of shuttle 70, an empty pouch 10 is moved by means 68 to reference point 71 where the pouch can be opened; the previous filled, unevacuated and unsealed pouch is moved by shuttle 70 to reference point 73 where the pouch can be evacuated and sealed; and the previous filled, evacuated and sealed pouch is pushed from the apparatus by means 76. As soon as means 74 has completed evacuating and sealing the pouch resiliently engaged by shuttle 70, the completed package is released from shuttle 70 which then moves back to the right to pick up the next empty pouch and the next filled pouch.

DETAILED DESCRIPTION

Figure 4:
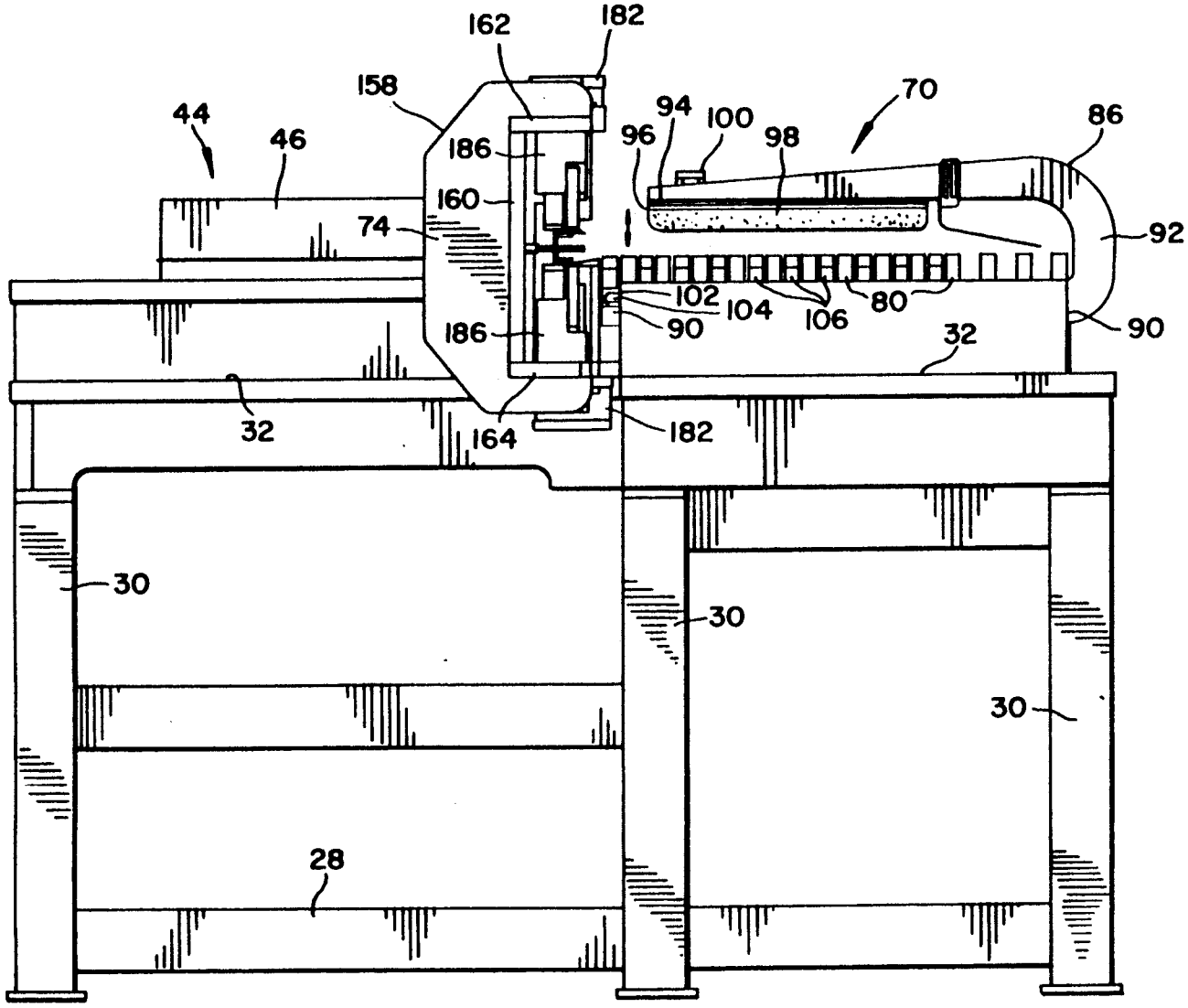
FIG. 4 shows a side elevation view of the apparatus of the invention, as seen from the left in FIG. 3.
Figure 6:
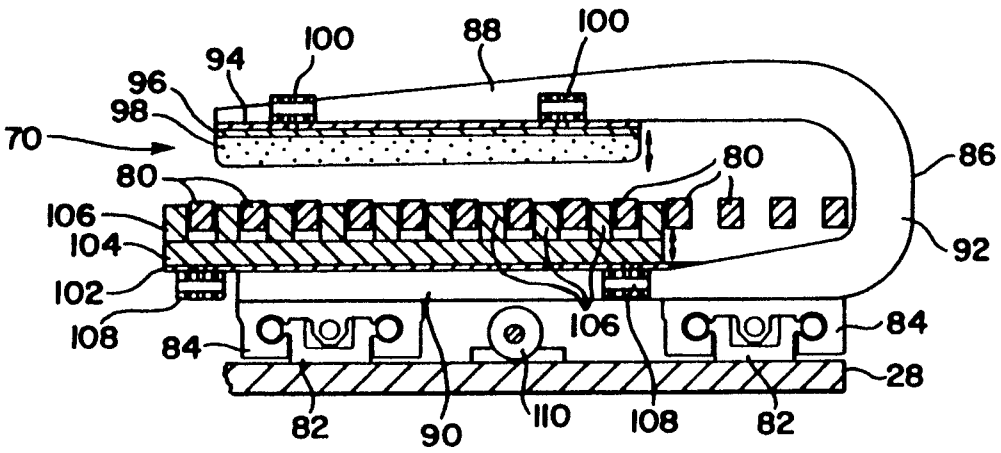
FIG. 6 shows a section view through the shuttle means and the means for resiliently engaging an object, taken along line 6—6 of FIG. 3.

As shown in FIGS. 3, 4 and 6, mounted on frame 28 is an elongated table comprising a support surface 78 formed by a plurality of elongated, spaced bars 80 with elongated slots therebetween. Beneath support surface 78 are mounted a pair of conventional rails 82 which extend parallel to bars 80. A pair of conventional carriages or slides 84 are mounted on rails 82 in the familiar manner and support a pair of upwardly extending and parallel C-shaped brackets or frames 86. Each bracket 86 includes a first, generally horizontal element 88 which extends above support surface 78, a second, generally horizontal element 90 which extends beneath support surface 78 and is attached to slides 84, and an integral upwardly extending portion 92. An upper fixed plate 94, of rectangular configuration preferably somewhat larger than the largest pouch 10 to be used, is attached to the underside of elements 88. An upper movable plate 96, preferably congruent with fixed plate 94, is provided on its underside with a layer or pad 98 of resilient polymeric foam. The foam should be soft enough to be compressed as the stack of film enters the pouch, but firm enough to prevent the stack from spilling forward at the end of the loading stroke or during transfer to evacuating and sealing means 74. Movable plate 96 and pat 98 are positioned beneath fixed plate 94; and plate 96 is supported by the actuator rods of a preferably rectangular array of pneumatic actuators 100 mounted on the upper side of fixed plate 94 with their actuator rods extending downwardly through openings, not illustrated, in fixed plate 94. Thus, operation of actuators 100 causes plate 96 and pad 98 to move downward toward support surface 78 to resiliently engage an object through the walls of its pouch or to move upward away from support surface 78 to release a pouch and object. Depending on the height of the object to be packaged, pad 98 is positioned by actuators 100 at a distance above support surface 78 which will cause the pad to be compressed as the object moves into the pouch, thus resiliently engaging the object as it is inserted.

A lower fixed plate 102, preferably of rectangular configuration and at least as large as pat 98 is attached to the upper side of elements 90. A lower movable plate 104, preferably congruent with the portion of plate 102 bneath pad 98, is provided on its upper side with a plurality of elongated members or bars 106 which are positioned opposite the slots between bars 80 which form support surface 78. Movable plate 104 and bars 106 are positioned on fixed plate 102 and attached to the actuator rods of a preferably rectangular array of pneumatic actuators 108 mounted on the underside of fixed plate 102 as shown in FIG. 6. The actuator rods of actuator 108 extend upwardly through openings, not illustrated, in fixed plate 102. Thus, operation of actuators 108 causes plate 104 and bars 106 to move upward toward support surface 78; so that, bars 106 pass between bars 80 to engage the underside of an object through the walls of its pouch and lift the object above support surface 78, or to move downward away from support surface 78 to release a pouch and object. Thus, when actuators 100 and 108 are actuated together, the pouch and object are resiliently engaged or released, as the case may be. Shuttle 70 is moved along rails 82 by means of a conventional long stroke actuator 110 mounted between frame 28 and the carriage formed by elements 86 and 94 to 98.

Figure 7:
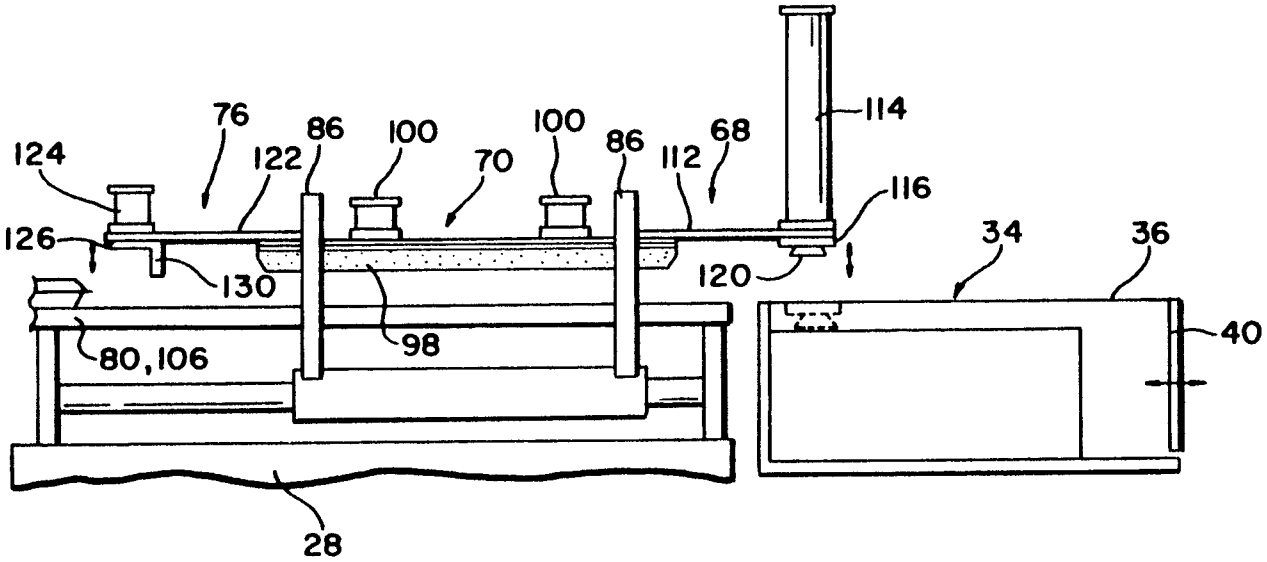
FIG. 7 shows a partial front elevation view of the apparatus of the invention, taken along line 7—7 of FIG. 3.

As shown in FIGS. 3 and 7, means 68 for removing pouches 10 from hopper 34 comprises an upper support plate 112 attached to upper fixed plate 94 and extended essentially parallel to bars 80. A pneumatic actuator 114 is mounted on the upper side of plate 112 with its actuator rod extended through a hole in plate 112 to support a lower transverse support plate 116 whose length preferably is great enough to effectively span the length of the longest pouch 10 to be used. A conventional guide rod 118 is provided between plates 112 and 116 to prevent support plate 116 from rotating beneath actuator 114. On the underside of support plate 116 are provided a plurality of individually actuatable suction cups 120 at locations to acquire pouch 10 along its edge. Depending on the length of the pouch in use, more or fewer of suction cups 120 may be used, as will be understood by those skilled in the art. Thus, when means 68 is positioned as shown in FIG. 3, actuator 114 is extended to engage suction cups 120 with a pouch and then withdrawn to position the acquired pouch above support surface 78. Shuttle 70 then moves to the left as viewed in FIG. 3 to position the pouch at reference point 71, whereupon the pouch is released from suction cups 120. As will be understood by those skilled in the art, actuator 114 can have a much shorter stroke than that illustrated in FIG. 7, if hopper 34 is provided with conventional means for maintaining the uppermost pouch at an essentially constant level.

Also as shown in FIGS. 3 and 7, means 76 for removing a pouch from support surface 78 comprises an upper support plate 122 attached to fixed upper plate 94 and extended essentially parallel to bars 80. A pneumatic actuator 124 is mounted on the upper side of plate 122 with its actuator rod extended through a hole in plate 122 to support a lower transverse pusher plate 126 whose length preferably is great enough to effectively span the length of the longest pouch 10 to be used. A conventional guide rod 128 is provided between plates 122 and 126 to prevent support plate 126 from rotating beneath actuator 124. As seen in FIG. 7, pusher plate 126 comprises a downwardly projecting flange 130 along its length for engaging the side of a package to be pushed from support surface 78. Thus, when means 76 is positioned as shown in FIG. 3, the rod of actuator 124 is extended to position flange 130 just above support surface 78; so that, when shuttle 70 moves to the left, the previously evacuated and sealed package will be pushed from support surface 78. Then, before shuttle 70 moves back to the right, the rod of actuator 124 is withdrawn to position flange 130 high enough to clear the following pouch which has just been sealed by means 74.

Figure 5:
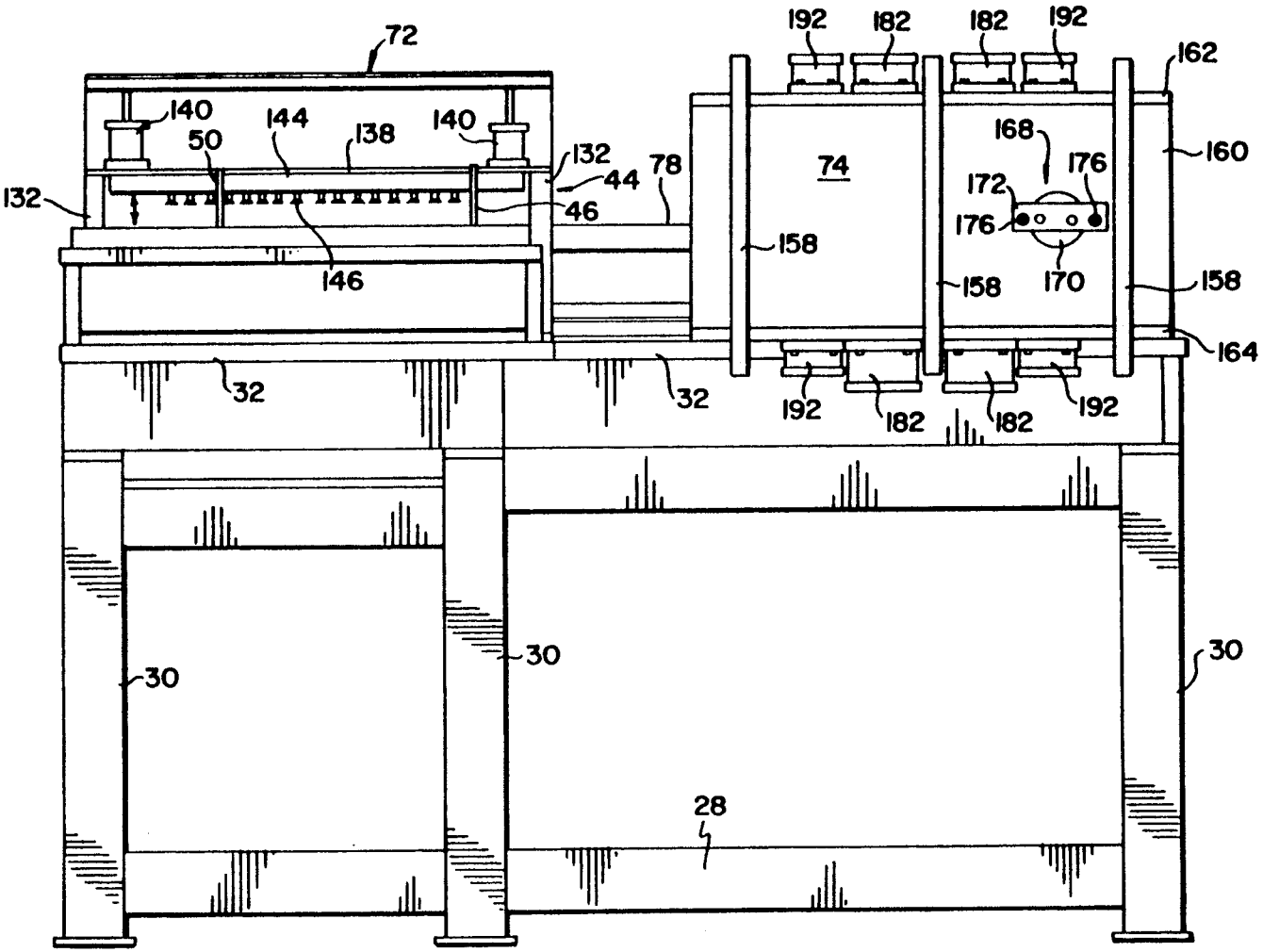
FIG. 5 shows a rear elevation view of the apparatus of the invention, as seen from the top in FIG. 3.
Figure 8:
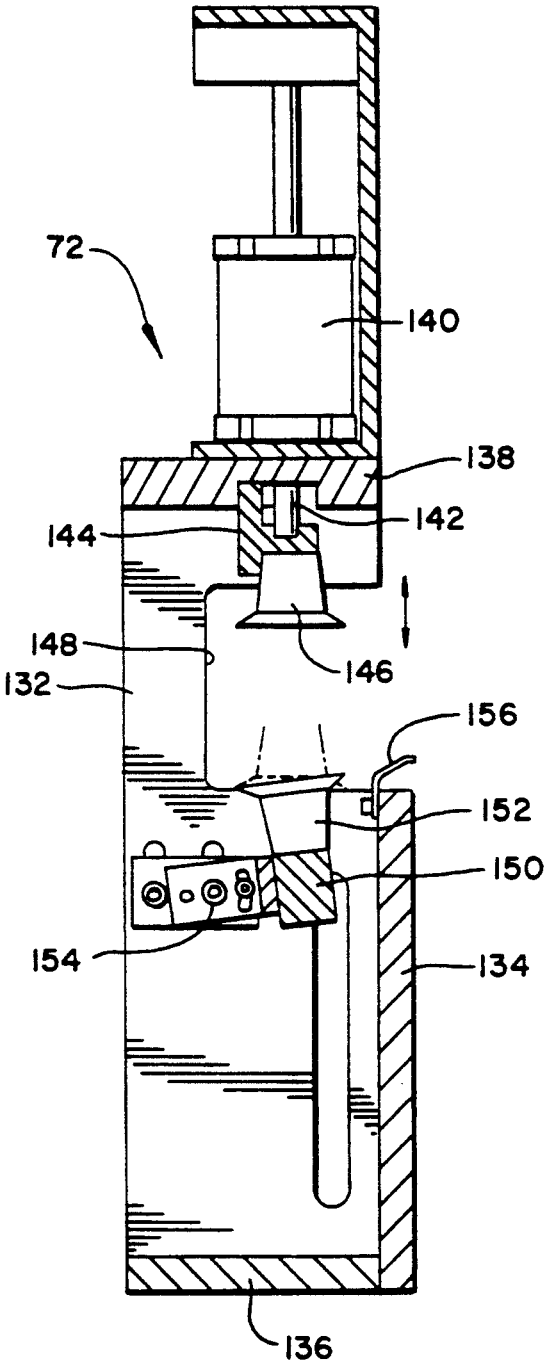
FIG. 8 shows a section view through the means for opening a pouch, taken along line 8—8 of FIG. 3.
Figure 9:
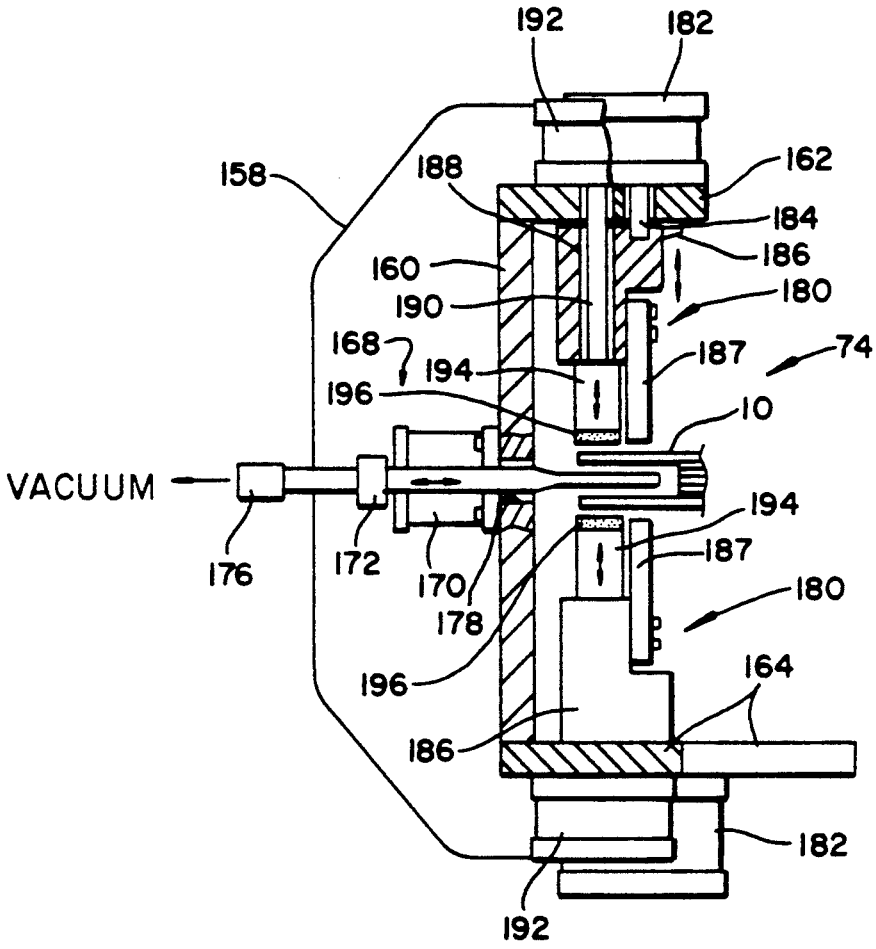
FIG. 9 shows a section view through the means for evacuating and sealing a pouch, taken along line 9—9 of FIG. 3.

As shown in FIGS. 3, 5 and 8, means 72 for opening the mouth of a pouch 10 comprises a pair of upwardly extending mounting brackets 132 positioned outside the walls of nest 44, as seen best in FIG. 5. A front plate 134 extends between brackets 132 at a location below the level of support surface 78, while a base plate 136 and a top plate 138 complete the frame of means 72. A pair of pneumatic actuators 140 are mounted on the upper surface of top plate 138, one near each end as shown in FIG. 5. The actuator rods 142 of actuators 140 extend through suitable holes in top plate 138 and are attached to the opposite ends of a top support bar 144 which extends between brackets 132. A plurality of suction cups 146 are mounted on the under side of top support bar 144 with the mouths of the suction cups facing the plane of support surface 78. A notch 148 is provided in each bracket 132 with the lower edge of the notch at about the level of support surface 78, to allow pouch 10 carried by means 68 to move beneath suction cups 146. Below notch 148, a bottom support bar 150 extends between brackets 132 and supports a plurality of suction cups 152 facing upwardly toward the plane of support surface 78. Bottom support bar 150 is mounted between brackets 132 by means of a pair of adjustable mounting brackets 154, only one of which is visible in FIG. 8. Suction cups 152 preferably are set at a slight angle toward nest 44, as illustrated; so that, they will pull the lip of the pouch below the path of the object and prevent stubbing of the object on the lead edge of the pouch during movement of the object from nest 44. Finally, a guide lip 156 is mounted near the upper edge of and extends across the width of front plate 134 to guide an object as it moves into an opened pouch and onto support surface 78. In operation, shuttle 70 moves to the left as viewed in FIG. 3 and means 68 brings along an empty pouch 10 which is positioned at reference point 73, as previously discussed. Actuator rods 142 are then extended to engage suction cups 146 and 152 with the side walls of the pouch near its mouth, suction is applied and actuator rods 142 are retracted to open the mouth of the pouch. Means 60 is then extended to push an object from nest 44 into the waiting pouch where the object and the pouch are resiliently engaged by pad 98 on shuttle 70.

As shown in FIGS. 3, 4, 5 and 9, means 74 for evacuating and sealing a pouch comprises three C-shaped brackets 158 which are rigidly attached to a back plate 160, a top mounting plate 162 and a bottom mounting plate 164 which is fixed to frame 28 beneath support surface 78. After an object has been inserted into a pouch in the manner previously described, shuttle 70 moves to the left as viewed in FIG. 3, while still resiliently engaging the pouch and object, and positions the upper left corner of the pouch at reference point 73; so that, each pouch is properly positioned for evacuating and sealing, without regard to the size of the pouch. At the end of means 74 nearer reference point 73, a pouch evacuation apparatus 168 is provided which comprises a pneumatic actuator 170 attached to the back side of back plate 160. The actuator rod of actuator 170 extends toward the rear of the apparatus and fixedly supports a transverse support block 172 for a pair of evacuator probes or tubes 176 which extend forwardly through suitable holes 178 in back plate 160. Probes 176 are positioned essentially on the centerline of the open mouth of a pouch, as indicated fragmentarily in FIG. 9, and are connected to a suitable vacuum source.

Above and below probes 176 are mounted upper and lower pouch closing and sealing jaws 180 which comprise upper and lower pairs of pneumatic actuators 182 having actuator rods 184 which extend through suitable holes in mounting plates 162, 164 and support transversely extending mounting bars 186. Attached to bars 186 are pairs of aligned, oppositely facing and transversely extending heat sealing bars 187, which preferably are electrically actuated. Each mounting bar 186 comprises a pair of vertically extending bores 188 positioned behind sealing bar 187. Through each bore 188 extends the actuator rod 190 of one of upper and lower pairs of pneumatic actuators 192 mounted on plates 162,164 next to actuators 182. The ends of actuator rods 190 support aligned, oppositely facing and transversely extending pouch closing bars 194, each having a layer 196 of foam rubber or similar resilient material on its surface facing probes 176.

When shuttle 70 has positioned a filled pouch at reference point 73, actuator 170 is actuated to extend probes 176 through the mouth of the pouch into fairly close proximity to the enclosed object. Actuators 192 are then actuated to extend closing bars 194 into contact with the side walls of the pouch, thus compressing layers 196 to provide a good mechanical seal between the side walls and around the extended probes 176. Vacuum is then applied to probes 176 for a time sufficient to evacuate the pouch, after which probes 176 are withdrawn behind sealing bars 187, but with vacuum still being drawn. Actuators 182 are then actuated to press sealing bars 187 into contact with the pouch to form seal 26 and complete the package. Vacuum is then stopped and actuators 182,192 are deactuated to release the package. Simultaneously, shuttle 70 releases the package and returns to pick up the next empty pouch.

ADVANTAGES OF THE INVENTION

The apparatus and process of our invention provide the advantage that objects which would tend to reorient or shift during insertion into or movement with a pouch are resiliently engaged through the walls of the pouch during insertion and movement, thus preventing such unwanted reorienting or shifting. Because each pouch, without regard to the size of the pouch, is positioned for filling at a fixed reference point and then for evacuating and sealing at a further fixed reference point, the apparatus and process have the further advantage of being able to change readily from one size of pouch and object to another. Finally, since each pouch is loaded and sealed at only one edge, other functional features can be provided on the other edges of the pouch without necessitating changes to the apparatus or process of the invention.

While our invention has been shown and described with reference to particular embodiments thereof, those skilled in the art will understand that other variations in form and detail may be made without departing from the scope and spirit of our invention.

Having thus described our invention in sufficient detail to enable those skilled in the art to make and use it, we claim as new and desired to secure Letters Patent for:

1. Apparatus for packaging objects, comprising:
a source of pouches for said objects, each pouch having side walls and an open mouth;
a support surface;
means for removing a pouch from said source and placing said pouch on said support surface;
means for opening said mouth of said pouch;
means for receiving each said object at a position opposite said mouth;
means for pushing said object from said means for receiving through said mouth into said pouch; and
means for moving said pouch with said object along said support surface away from said means for opening and said means for receiving, said means for moving comprising means for resiliently engaging said object through said side walls of said pouch initially as said object is pushed into said pouch and thereafter when said object is within said pouch, to prevent said oject from shifting during movement into or with said pouch.

2. Apparatus according to claim 1, further comprising:
means spaced along said support surface from said means for opening for evacuating the interior of said pouch and sealing said pouch at said mouth.

3. Apparatus according to claim 2 wherein said means for moving moves said pouch and said object a fixed distance from said means for opening to said means for evacuating and sealing, without regard to the size of said pouch or said object.

4. Apparatus according to claim 1, wherein said means for removing a pouch is mounted on said means for moving said pouch and object.

5. Apparatus according to claim 2, further comprising means, mounted on said means for resiliently engaging, for removing a pouch and object from said support surface after said evacuating and sealing.

6. Apparatus according to claim 1, wherein said pouch comprises a feature associated with said mouth and said means for removing and placing said pouch positions said feature at a fixed location on said support surface, without regard to the size of said pouch or said object.

7. Apparatus according to claim 1, wherein said support surface comprises a plurality of longitudinally extending slots and said means for resiliently engaging comprises:
a frame having a first element extending above said support surface and a second element extending beneath said support surface;
a resilient pad;
means mounted on said first element for supporting said resilient pad facing said longitudinally extending slots and for moving said resilient pad toward and away from said longitudinally extending slots;
a plurality of elongated members positioned opposite respective ones of said longitudinally extending slots beneath said support surface; and
means mounted on said second element for supporting said elongated members and for moving said elongated members through said longitudinally extending slots toward said pad and withdrawing them from said longitudinally extending slots, thereby to cause said pad and said elongated members to engage and release opposite sides of said pouch and said object.

8. Apparatus according to claim 7, further comprising:
means spaced along said support surface from said means for opening for evacuating the interior of said pouch and sealing said pouch at said mouth.

9. Apparatus according to claim 8, wherein said means for moving moves said pouch and said object a fixed distance from said means for opening to said means for evacuating and sealing, without regard to the size of said pouch or said object.

10. Apparatus according to claim 8, wherein said means for removing a pouch is mounted on said means for moving said pouch and object.

11. Apparatus according to claim 8, further comprising means, mounted on said means for resiliently engaging, for removing a pouch and object from said support surface after said evacuating and sealing.

12. Apparatus according to claim 7, wherein said pouch comprises a feature associated with said mouth; and said means for removing and placing said pouch positions said feature at a fixed location on said support surface, without regard to the size of said pouch or said object.

13. A process for packaging objects, comprising the steps of:
providing a source of pouches for said objects, each pouch having side walls and an open mouth;
providing a support surface;
removing a pouch from said source and placing said pouch on said surface;
opening said mouth of said pouch;
placing each said object at a position opposite said mouth;
pushing said object through said mouth into said pouch;
initially during said pushing step, resiliently engaging said object through said side walls of said pouch to prevent said object from shifting during movement into said pouch; and
moving said pouch and said object along said support surface after said pushing step while continuing to resiliently engage said object through said side walls of said pouch to prevent shifting during movement.

14. A process according to claim 13, further comprising the steps of:
evacuating the interior of said pouch;
sealing said pouch at said mouth; and
releasing said pouch and said object.

15. A process according to claim 14, wherein said pouch and said object are moved a fixed distance along said support surface after said pushing step and before said evacuating and sealing steps, without regard to the size of said pouch or said object.

16. A process according to claim 14, further comprising the step of removing said pouch and object from said support surface after said evacuating and sealing steps.

* * * * *